United States Patent [19]

Kuhl et al.

[11] 4,124,947

[45] Nov. 14, 1978

[54] GRAPHIC PATTERN OR THE LIKE AND METHOD OF PRODUCING THE SAME

[76] Inventors: Adolf Kuhl, Hubstrasse 13A, 8942 Oberrieden; Ernst Heistand, Chüpliweg 6, 8702 Zollikon, both of Switzerland

[21] Appl. No.: 740,130

[22] Filed: Nov. 8, 1976

[30] Foreign Application Priority Data

Nov. 14, 1975 [CH] Switzerland ..... 014889/75
Jan. 30, 1976 [DE] Fed. Rep. of Germany ..... 2603558

[51] Int. Cl.[2] ..... G09F 19/14

[52] U.S. Cl. ..... 40/453; 101/150; 101/211; 283/8 R; 427/7

[58] Field of Search ..... 101/150, 170, 211; 283/8 R, 8 B; 40/137; 427/7

[56] References Cited

U.S. PATENT DOCUMENTS

| | | | |
|---|---|---|---|
| 1,299,484 | 4/1919 | Lee | 283/8 R |
| 2,248,129 | 7/1941 | Sheridan et al. | 40/137 |
| 3,878,631 | 4/1975 | Milehan | 40/137 |
| 3,887,742 | 6/1975 | Reinnagel | 283/8 R |
| 4,033,059 | 7/1977 | Hutton | 101/151 |

FOREIGN PATENT DOCUMENTS

| | | | |
|---|---|---|---|
| 327,924 | 6/1902 | France | 40/137 |

*Primary Examiner*—William Pieprz
*Attorney, Agent, or Firm*—Werner W. Kleeman

[57] ABSTRACT

A method of producing a graphic pattern and a graphic pattern for imprinting substrates, such as documents, especially paper currency, stamps or the like, with lines in the form of lengthwise extending color mounds or peaks is disclosed. There is provided a line grid or pattern which is substantially uniform at least in given field sections and comprises relatively closely juxtaposed non-intersecting and non-contacting lines. The ratio between the height and the spacing of the color mounds forming the lines is selected such that when viewing the pattern below a predetermined boundary inclination angle the base of the valleys between the color mounds or peaks is not visible.

28 Claims, 13 Drawing Figures

GRAPHIC PATTERN OR THE LIKE AND METHOD OF PRODUCING THE SAME

BACKGROUND OF THE INVENTION

The present invention relates to a new and improved construction of a graphic pattern, design or the like — hereinafter simply referred to as a pattern — for imprinting substrates, particularly various documents, such as especially paper currency, stamps or the like, with lines in the form of lengthwise extending color peaks or mounds, applied especially by means of an intaglio printing process to the substrate.

Patterns having numerous intersecting lines, in which there are also present parallel lines, are known, for instance for printing paper currency. Irrespective of the line of sight or viewing angle at which such type patterns are observed, there is always present the same brightness effect or impression.

SUMMARY OF THE INVENTION

It is a primary object of the present invention to provide a new and improved graphic pattern wherein the impression upon the viewer alters as a function of the viewing angle, additionally, the authenticity of the pattern can be readily ascertained and duplication of the pattern is extremely difficult.

Still a further significant object of the present invention aims at the provision of a novel method of producing a graphic pattern, typically but not exclusively for paper currency, which enables providing a pattern which alters in dependency upon the viewing angle, and additionally, allows incorporation into the pattern of suitable markings or the like which are only visible when looking at the pattern from a certain line of sight, thereby assisting in checking the authenticity of the pattern.

Now in order to implement these and still further objects of the invention, which will become more readily apparent as the description proceeds, the invention contemplates providing a line grid formed of relatively closely situated non-intersecting and non-contacting lines, wherein the line grid is arranged at least in predetermined field sections or zones. Further, the ratio between the height and the spacing of the color mounds or peaks forming the lines is chosen such that when viewing the pattern below a predetermined boundary inclination angle the base of the valleys between the color peaks is not visible.

The aforementioned ratio is equivalent to the tangent of the inclination angle, below which there must be observed the pattern in the boundary position, and starting from such boundary position there is only still visible the color mounds or peaks.

When observing the pattern according to the invention at an angle measured with respect to the surface of the pattern, the tangent of which is smaller or equal to the aformentioned ratio, then the observer only sees parts of the color peaks or mounds and not parts of the substrate — such as a paper note or currency — in the valleys between the color mounds. The pattern according to the invention produces a novel aesthetic effect which is predicated upon the three dimensional aspects of the pattern. This effect is apparent in terms of a darkening- and brightening effect when tilting the substrate. Further, the inventive pattern can be easily checked as to its authenticity and at the same time it is difficult to forge or reproduce the same, because owing to its uniform character at least in field sections or zones and due to the brightness effect during tilting or pivoting of the substrate it is possible to easily optically determine irregularities. This renders the pattern especially suitable for printing securities, particularly paper currencies and checks.

The authenticity of paper currency should be easily capable of being checked not only by the expert but also by the layman, and, furthermore, such paper currency should be extremely difficult to forge or reproduce. Both aspects should increase the security against forgery, in that both the actual forgery as well as the placing into circulation of forged paper currency is rendered much more difficult.

With presently conventional paper currency the layman has the opportunity to check for forgeries by means of a metal thread incorporated into the paper currency. Additionally, to check for forgeries there are formed in the pattern deviations along the principle of picture puzzles, which, however, are difficult to detect by the layman and therefore can be ignored by the forger, thus making it easier to forge currency or the like.

Now in order to provide the layman with a more positive possibility of determining that the paper currency which they are holding is not forged or counterfeit, and without requiring any additional expenditure during the fabrication of the paper currency, it is a further advantageous aspect of the present invention to provide at least one interruption in the line grid which intersects the lines.

If the observer tilts a piece of paper or other substrate provided with a pattern produced according to the invention in the above-explained manner, such that they only still see, for instance, the dark color mounds or peaks and now if the paper is turned such that the interruption is visible, then there clearly appears the contrast between the color of the lines and that of the substrate. This principle permits the layman to carry out a very simple and effective check of the authenticity of the involved paper or document.

The interruption is advantageously formed by a passageway or so to speak "street" which essentially extends transversely through the lines of the line grid or pattern. A number of such passageways or streets also can be provided, which advantageously extend parallel and essentially linearly.

The authenticity check for the expert is predicated upon the principle that at optically uniform structures errors can be detected more quickly and clearly than at irregular structures, as such were previously employed. However, in order to render counterfeiting practically almost impossible, the line grid according to a further feature of the invention is continuously or continually changed in field sections or zones, for instance according to a predetermined program. Thus, the lines which extend essentially parallel to one another can be distorted in a hook- and/or arc-shaped manner. Moreover, each line can be distorted or deformed so as to deviate in relation to the neighboring lines. Finally, deformations of the line grid in the form of waves or the like are possible.

The line grid of the invention optically imparts a uniform impression, although the grid changes from surface unit to surface unit. Thus, there is simultaneously insured both easy recognizability by the expert and difficult counterfeiting. It is known that during photographic counterfeiting line details become lost.

Attempts to manually augment such gaps or spaces is not practically possible, and with a regular or uniform basic pattern, as produced by the invention, in fact can be detected by the layman.

With conventional copper plate engraving with partial point resolution of the lines and their intersection points, detection of the authenticity is considerably more difficult and the possibility of forgery greater.

A pattern produced according to the invention is preferably fabricated in such a manner that there is formed a substantially uniform line grid or pattern which changes with regard to the course of the lines according to a predetermined program, the line pattern preferably being formed by means of a guilloche machine and then applied to the substrate by means of a steel plate engraving process.

As to the pattern formed according to the invention, in principle an infinite number of variation possibilities exist by different programming thereof. Therefore, the pattern of the invention can be correspondingly altered for a series of paper currency, yet, the uniformity of the currency series is ensured by employing the same basic principle.

As mentioned, the invention not only concerns the aforementioned graphic pattern or the like, but also deals with a method of producing the same wherein there is provided a substrate, color mounds are applied to the substrate such that there is formed a pattern of colored portions spaced from portions of the substrate devoid of color, such that when viewing the substrate below a certain angle of inclination there is not visible the base or portions of the substrate devoid of color between the portions bearing color.

According to a further aspect of the invention there is formed at the colored portions interruptions which are visible in the form of a passageway or street only when viewing the substrate at an angle below a predetermined inclination angle.

BRIEF DESCRIPTION OF THE DRAWINGS

The invention will be better understood and objects other than those set forth above, will become apparent when consideration is given to the following detailed description thereof. Such description makes reference to the annexed drawings wherein.

DETAILED DESCRIPTION OF THE PREFERRED EMBODIMENTS

Describing now the drawings, in FIGS. 1 to 5 there is shown in a simplified illustration a section of a line pattern or grid designed according to the present invention, namely having, by way of example, straight lines 7 in the form of lengthwise extending color mounds or peaks 1 applied to a suitable substrate 2, for instance paper currency. The color bearing portions i.e. the color mounds or peaks 1 have a height $t$ and a base or valley spacing $b$ in the plane of the substrate 2.

Figure 3:
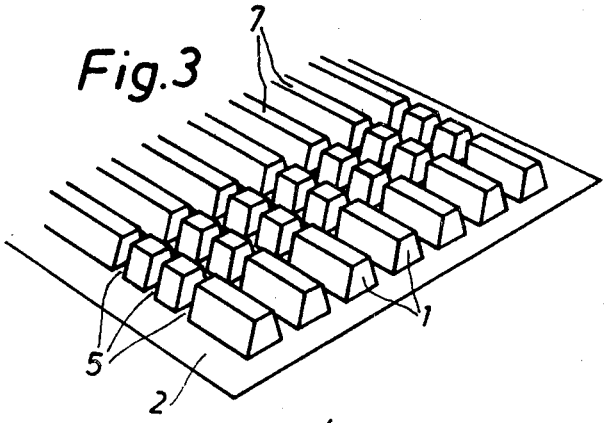
FIGS. 3, 4 and 5 respectively illustrate different perspective views of a line pattern or grid arrangement according to FIGS. 1 and 2.
Figure 1:
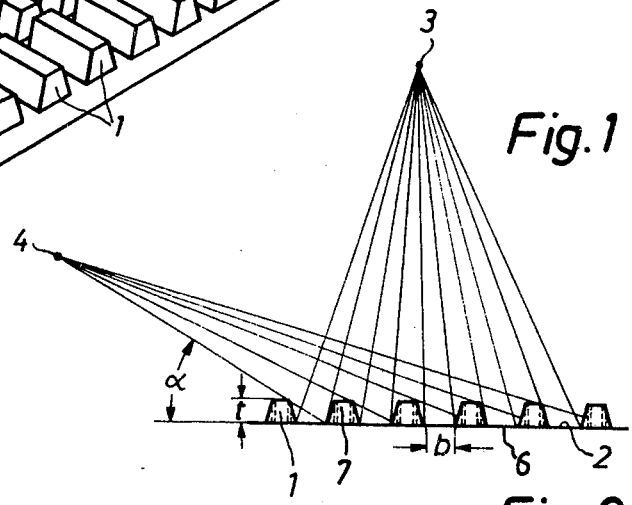
FIG. 1 is a side view of a substrate containing color mounds or peaks produced in accordance with the invention and serving to explain the principles thereof.
Figure 2:
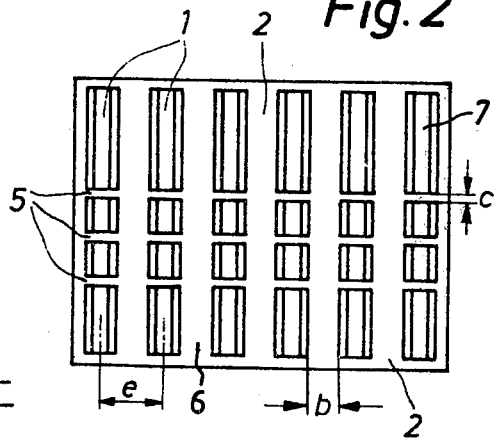
FIG. 2 is a plan view of a portion of the line pattern or grid applied to the substrate in accordance with the invention.
Figure 4:
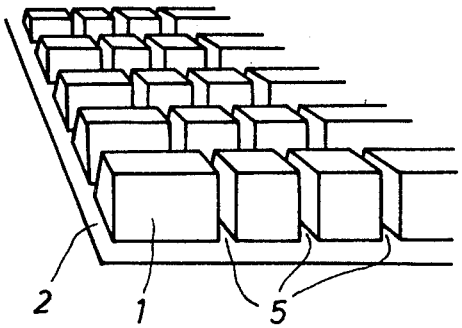
Figure 5:
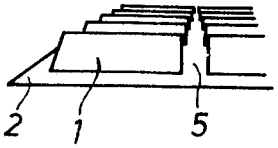

In FIG. 1 there have been shown two viewing or observation points 3 and 4, from which an observer is capable of viewing the paper currency or the like. When looking from point 3 the observer sees both the color mounds or peaks 1 as well as also the parts 6 of the substrate 2 located in the intermediate valleys i.e. the portions of the substrate devoid of color.

On the other hand, when viewing the pattern from point 4 the observer sees only part of the color mounds 1. With bright substrate 2 and dark color mounds 1 the observer receives the impression of an intermediate tone, for instance a grey tone when looking from point 3, whereas when looking from point 4 he only perceives the dark tone or shade of the color mounds or peaks 1. If the observer pivots or tilts the paper currency from a vertical viewing direction into an inclined viewing direction, then there is present a continuous darkening of the image.

From the showing of FIGS. 2 to 5 it will be apparent that the color mounds 1 are pierced or interrupted by three substantially parallel transverse passageways or streets 5 having a smaller width $c$ than the spacing or distance $b$ between two juxtaposed lines 7. Now if the substrate 2, while viewing the same front point 4 or from a lower situated sighting point in FIG. 1, is rotated such that one or a number of the passageways or streets 5 come into the line of sight or viewing field of the observer, then the observer, owing to the more pronounced bright-dark contrast between the color of the substrate 2 and the color mounds or peaks 1, immediately recognizes the passageways or streets 5 and, thus, for instance the genuineness of the paper currency.

Starting from point 4 in FIG. 1 there is plotted the boundary inclination angle $\alpha$ for the relevant ratio $t/b$, at which the observer just no longer sees any of the surface of the substrate 2 in the valleys 6 between the color mounds 1. If the point 4 is shifted somewhat upwards or if the substrate 2 is rocked somewhat more to the perpendicular to the path of the rays from the point 4, then the observer will see part of the valleys 6 between the color mounds or peaks 1. With very small spacing $b$ such will be merely perceived as a brightening of the image of the pattern which is presented to the observer.

It will be apparent that this boundary inclination angle $\alpha$ can be varied by changing the ratio $t/b$. Advantageously, the aforementioned ratio lies in a range between about 0.5 and 2.0. In the illustrated example the ratio $t/b$ amounts to about 0.7. With constant width the boundary inclination angle designated in FIG. 1 by the symbol $\alpha$ increases as the value $t$ becomes greater and decreases as such value $t$ becomes smaller. In the last instance the observer must view the paper currency in a still more markedly inclined position in order to receive the impression of complete darkness and then to more easily discern the bright street or passageway 5 for the detection of the authenticity or genuineness of the paper currency.

Figure 6:
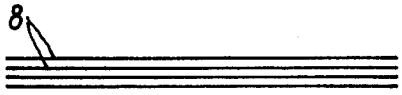
FIGS. 6 to 13 respectively illustrate different variations of the line pattern of the invention.

In FIG. 6 there is shown schematically a basic pattern which is possible for the color mounds, shown in the form of parallel lines 8, for instance like the lines 7 of FIGS. 1 to 5, whereas in FIGS. 7 to 11 there have been illustrated various modifications of such pattern with distortions or deviations of such lines.

With the patterns shown respectively in FIG. 7 to 11 the basic course of the lines 9, 10, 11, 12, 13 respectively, is maintained as heretofore to be essentially linear and parallel.

Figure 7:
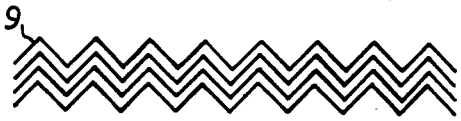
Figure 8:
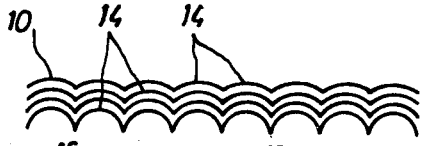
Figure 10:
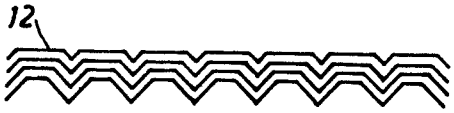

In particular, with the pattens of FIGS. 7 and 10 the distortions are in the form of essentially zig-zag shaped lines or sawtooth-shaped lines 9 and 12, respectively, whereas for the pattern of FIG. 8 there have been shown arc-shaped distortions or deflections of the lines 10 i.e. in the form of arcs 14 arranged in a row next to one another, each line 10 consisting of a continuous series of such arcs 14. It will be apparent from the showing of FIG. 8 the radius of curvature of the adjacently situated arcs can vary. Thus, by way of example, the radius of curvature of the lowermost sequence of arcs or arc-shaped portions 14 shown in FIG. 8 is considerably smaller than that of the uppermost sequence of arcs.

Figure 9:
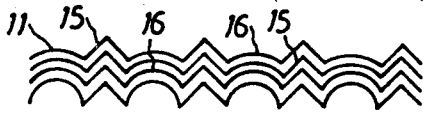

As to the pattern of FIG. 9 such basically is like that of FIG. 8 but there has been additionally incorporated therein the tooth-like or zig-zag portions 15 between the arc portions or sections 16 of the lines 11.

Figure 11:
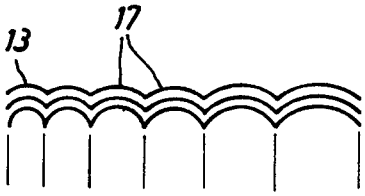

With the pattern of FIG. 11 both the radius of curvature of the arc or undulated portions 17 vary in the same manner as in FIG. 8 from one line to the next and also within a continuous train of such arcs, and also the arc length varies within the arc train.

Figure 12:
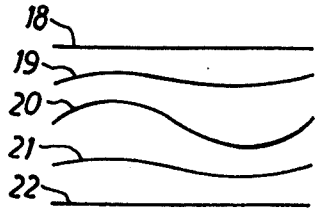

The distorted lines 9 to 13 of the patterns illustrated in FIGS. 7 to 11 can have superimposed thereon a distortion corresponding to the wave-like or wavy lines 19 to 21 illustrated in FIG. 12 i.e. the lines 18 to 22 which are variously configured and located adjacent one another in FIG. 12 additionally can be distorted by means of any one of the patterns of FIGS. 7 to 11 or various combinations thereof. Stated in another way, for instance any one of the patterns of FIGS. 7 to 11 can have the different distorted lines 9 to 13 extend along the lines 18, 22 and the curved or wave-like lines 19 to 21 shown in FIG. 12.

Both the distortion of the lines 9 to 13 according to FIGS. 7 to 11 as well as also the different deformation or alterations of the course of the lines, such as especially the wavy lines 19 to 21 upon which there is superimposed the distorted lines, as previously explained, is carried out such that when viewing the pattern there remains the impression of esentially linear and parallel lines.

Figure 13:
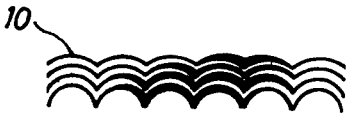

FIG. 13 illustrates a pattern according to the showing of FIG. 8, wherein the line intensity is thickened locally, as indicated by reference character 25, for accentuating a motif in the pattern. The described graphic pattern also can be used for other fields of application, such as, for instance, stamps, stocks, bonds, negotiable instruments and so forth.

In the case of graphical patterns of the described type, in practice the folowing values have come into consideration for the magnitudes shown in the drawings:

$\alpha = 20°-30°$
$t = 25-140\mu$
$b = 125-145\mu$
$c = 40-50\mu$
$e = 500\mu$

The magnitude $e$ is preferably maintained constant for a given pattern. When taking into account the above-indicated values the ratio $t/b$ varies approximately between 0.2 and 1. For a given pattern the ratio $t/b$ preferably remains essentially constant.

It is not absolutely necessary that the passageways or streets 5 are linear or straight. They also could be slightly curved or wave-shaped.

The width $c$ of the passageways or streets 5 is selected such that such passageways hardly cannot be detected if a xerographic copy or photograph is made.

However, in the event that with such duplication or reproduction techniques, such as xerography and photography, it is even possible to copy the passageways or streets 5, then the graphic effect realized with the invention can not be duplicated since the passageways 5 are only visible below a certain inclined position of the imprinted substrate.

The passageways 5 preferably must be located at printed zones or regions where the ratio between the printed to non-printed surface amounts to 2:1 to 3:1, so that the passageways 5, when viewed in plan, i.e. when looking from point 3 (FIG. 1) are not visible to the eye and only then become visible when looking from the point 4 (FIG. 1), i.e. only are clearly visible to the eye when the pattern is viewed below the predetermined boundary inclination angle $\alpha$ in the direction of the passageways 5.

It also would be conceivable to provide, instead of a line grid, a point grid i.e. series of spaced points in which there are provided the passageways or streets 5. In the last-mentioned instance the points must be chosen in such a manner and arranged offset with respect to one another such that when viewing the pattern below a boundary inclination angle $\alpha$ the non-printed background, with the exception of the passageways 5 between the points, is not visible.

While there are shown and described present preferred embodiments of the invention it is to be distinctly understood that the invention is not limited thereto, but may be otherwise variously embodied and practiced within the scope of the following claims. ACCORDINGLY,

What is claimed is:

1. A graphic pattern for imprinting substrates, especially paper currency, stamps or the like, comprising a substrate having thereon lines in the form of lengthwise extending color mounds, said lines comprising a line pattern which is substantially uniform at least in predetermined field sections of the substrate, said line pattern comprising relatively closely situated non-intersecting and non-contacting lines, the ratio between the height of the color mounds and the spacing of the color mounds forming the lines is such that when viewing the pattern from below a predetermined boundary inclination angle the base of valleys between the color mounds is non-visible, at least certain of said lines being provided with interruptions, all of the lines at least at the regions neighboring said interruptions extending essentially in the same direction, the substrate at said interruptions being devoid of color mounds, said interruptions having a width less than the spacing between the spacing of the majority of the color mounds forming the lines to thus render more difficult visible detection of the interruptions from a viewing angle above the predetermined boundary inclination angle while rendering the substrate at such interruptions more readily visible at a viewing angle below the predetermined boundary inclination angle due to increased contrast between the color mounds of the lines and the substrate at the interruptions.

2. The pattern as defined in claim 1, wherein the color mounds are applied to the substrate by an intaglio printing technique.

3. The pattern as defined in claim 1, wherein the line pattern is produced by a steel plate engraving process.

4. The pattern as defined in claim 1, wherein the width of the interruption is such that the interruption is first visible when viewing the pattern from below the predetermined boundary inclination angle.

5. The pattern as defined in claim 1, wherein the width of the interruption amounts to about 40–50 μ.

6. The pattern as defined in claim 1, wherein the interruption constitutes a passageway extending essentially transversely through the lines of the pattern.

7. The pattern as defined in claim 6, wherein the width of the interruption is selected such that the interruption is first visible when viewing the pattern from below the predetermined boundary inclination angle.

8. The pattern as defined in claim 6, wherein the width of the interruption amounts to about 40–50 μ.

9. The pattern as defined in claim 6, wherein the lines are provided with a plurality of interruptions to form a plurality of passageways.

10. The pattern as defined in claim 6, wherein each passageway extends substantially linearly and has a smaller width than the spacing between two neighboring lines.

11. The pattern as defined in claim 1, wherein said ratio is greater than 0.1.

12. The pattern as defined in claim 1, wherein said ratio is approximately equal to 0.1.

13. The pattern as defined in claim 1, wherein said ratio is greater than about 0.2.

14. The pattern as defined in claim 13, wherein said ratio is between about 0.5 and 2.0.

15. The pattern as defined in claim 9, wherein said ratio is in the order of about 0.7.

16. The pattern as defined in claim 1, wherein said ratio is substantially constant.

17. The pattern as defined in claim 1, wherein the spacing between the central axes of neighboring color mounds is substantially constant.

18. The pattern as defined in claim 1, wherein the line pattern continuously varies.

19. The pattern as defined in claim 1, wherein the lines extend essentially parallel to one another and are distorted in substantially hook-like configuration.

20. The pattern as defined in claim 1, wherein the lines extend essentially parallel to one another and are distorted in substantially arc-shape configuration.

21. The pattern as defined in claim 1, wherein each line is differently configured with regard to its adjacent line.

22. The pattern as defined in claim 1, wherein the line pattern is distorted in a substantially curve-shaped configuration.

23. The pattern as defined in claim 1, wherein the line pattern is distorted in a substantially zig-zag-shaped configuration.

24. The pattern as defined in claim 1, wherein the intensity of the lines is thickened in order to illustrate motifs.

25. The pattern as defined in claim 1, wherein the course of the lines of the line pattern continously varies as a function of a predetermined program.

26. A method of producing a graphic pattern for a substrate, comprising the steps of:

providing a substrate;

imprinting portions of the substrate with color mounds in the form of extended non-intersecting neighboring lines, at given locations between such lines there are provided portions devoid of color, such that in one position of the substrate the eye of the observer does not perceive the portions devoid of color and in another position the eye of the observer perceives the portions devoid of color; and providing at least certain of said lines with interruptions, all of the lines at least at the regions neighboring said interruptions extending essentially in the same direction, the substrate at said interruptions being devoid of color mounds, said interruptions having a width less than the spacing between the spacing of the majority of the color mounds forming the lines to thus render more difficult visible detection of the interruptions from a viewing angle above a predetermined boundary inclination angle while rendering the substrate at such interruptions more readily visible at a viewing angle below the predetermined boundary inclination angle due to increased contrast between the color mounds of the lines and the substrate at the interruptions.

27. The method as defined in claim 26, wherein at least certain of the portions devoid of color appear as an extended portion.

28. The method as defined in claim 27, wherein said extended portion is in the form of a substantially linear extending portion.

* * * * *